US005671618A

United States Patent [19]

Bianchini

[11] Patent Number: 5,671,618

[45] Date of Patent: Sep. 30, 1997

[54] PLATE PRESS FOR EMBOSSING OR GLAZING, PARTICULARLY FOR HIDES AND THE LIKE

[75] Inventor: Carlo Bianchini, Turbigo, Italy

[73] Assignee: VIPA S.r.l. Studio Progettazione Rappresentanze Conciarie, Turbigo, Italy

[21] Appl. No.: 524,924

[22] Filed: Sep. 8, 1995

[30] Foreign Application Priority Data

Sep. 28, 1994 [IT] Italy ..... MI94A1977

[51] Int. Cl.[6] ..... C14B 11/00

[52] U.S. Cl. ..... 69/48; 69/2; 100/215; 101/11

[58] Field of Search ..... 69/48, 2, 1, 46, 69/47, 8, 21; 100/215; 101/11, 27, 21, 25, 31, 9; 156/209, 219, 289; 264/284, 338

[56] References Cited

U.S. PATENT DOCUMENTS

| | | | |
|---|---|---|---|
| 3,507,733 | 4/1970 | Davidson | 264/284 |
| 3,563,827 | 2/1971 | Zylinski | 156/209 |
| 3,769,129 | 10/1973 | Williams | 156/209 |
| 3,982,988 | 9/1976 | Heimberger | 156/219 |
| 4,115,612 | 9/1978 | Closson, Jr. | 156/219 |
| 4,874,449 | 10/1989 | Schaefer et al. | 156/246 |

FOREIGN PATENT DOCUMENTS

| | | | |
|---|---|---|---|
| 414054 | 12/1966 | Switzerland | 69/48 |
| 259856 | 10/1926 | United Kingdom | 69/48 |
| 8301786 | 5/1983 | WIPO | 69/48 |

*Primary Examiner*—Michael A. Neas
*Attorney, Agent, or Firm*—Guido Modiano; Albert Josif

[57] ABSTRACT

A plate press for embossing or glazing, particularly for hides and the like, comprising a frame that supports a lower plate and an upper plate. An embossing plate for dressing the side of a hide is associable with one of the plates. The plate press comprises a film that is self-adapting, temperature-resistant, and can be interposed between the embossing plate and the hide to prevent the adhesion of the hide to the embossing plate.

20 Claims, 4 Drawing Sheets

PLATE PRESS FOR EMBOSSING OR GLAZING, PARTICULARLY FOR HIDES AND THE LIKE

BACKGROUND OF THE INVENTION

The present invention relates to a plate press for embossing or glazing, particularly for hides or the like.

In the field of hide dressing, in order to produce the surface finishing of the hide, the hides are embossed, for example in plate presses provided with an embossing or glazing plate that is appropriately heated and is placed in contact with the side of the hide to be dressed and impresses on the hide the patterns formed on the embossing plate.

According to current methods, the hides are loaded and placed manually beneath the plates of the press, and since the surface of the hides is usually greater than that of the plates of the press, the hides are embossed in consecutive sectors, making sure that the joints and overlaps are concealed as much as possible.

These operations require highly specialized personnel and furthermore significantly decrease the productivity of the machine, since the operator, after each embossing operation, must separate the hide from the embossing plate because the hide unavoidably adheres to said embossing plate.

The operators must thus separate the hide and make it advance so as to fully emboss or glaze the surface of the hide.

It is evident that this method is particularly tiring, since it is necessary to remove a hide while working close to the embossing plate, which is hot, and it is then necessary to cause the advancement of a hide that can be heavy.

Furthermore, the productivity of the machine is limited by the skill and speed of the operators, with obvious consequent high labor costs.

Other methods for dressing the surface of a hide entail applying on the hide a finishing layer that is placed on the hide by means of a transfer ribbon, that is to say, a ribbon that supports a coating layer which is transferred from the ribbon to the surface of the hide as it passes under the press; in this case, however, the side of the hide is not dressed, but a finishing layer, colored or dressed in any manner, is simply applied to the side of the hide.

SUMMARY OF THE INVENTION

A principal aim of the invention is indeed to solve the above described problems by providing a plate press for embossing or glazing, particularly for hides and the like, that allows to prevent adhesion between the hide and the embossing plate, thus simplifying all the related operations.

Within the scope of the above aim, a particular object of the invention is to provide an embossing or glazing plate press in which, since the hide and the embossing plate do not mutually adhere, it is possible to use an automatic feeder or loader that introduces the hide under the plate sequentially, so as to treat the side of the hide in a purely automatic manner without having to manually separate the hide and the embossing plate.

Another object of the present invention is to provide a plate press which is highly productive and is not conditioned by the skill of the operator in any way.

Still another object of the present invention is to provide an embossing or glazing plate press that can be easily obtained starting from commonly commercially available elements and materials and is furthermore competitive from a merely economical point of view.

This aim, these objects, and others which will become apparent hereinafter are achieved by a plate press for embossing or glazing, particularly for hides and the like, according to the invention, which comprises a frame that supports a lower plate and an upper plate, an embossing plate for dressing the side of a hide being associable with one of said plates, characterized in that it comprises a film that is self-adapting, temperature-resistant, and can be interposed between said embossing plate and said hide to prevent the adhesion of said hide to said embossing plate.

BRIEF DESCRIPTION OF THE DRAWINGS

Further characteristics and advantages will become apparent from the following detailed description of a preferred but not exclusive embodiment of a plate press for embossing or glazing, particularly for hides and the like, illustrated only by way of non-limitative example in the accompanying drawings, wherein.

DESCRIPTION OF THE PREFERRED EMBODIMENTS

Figure 1:
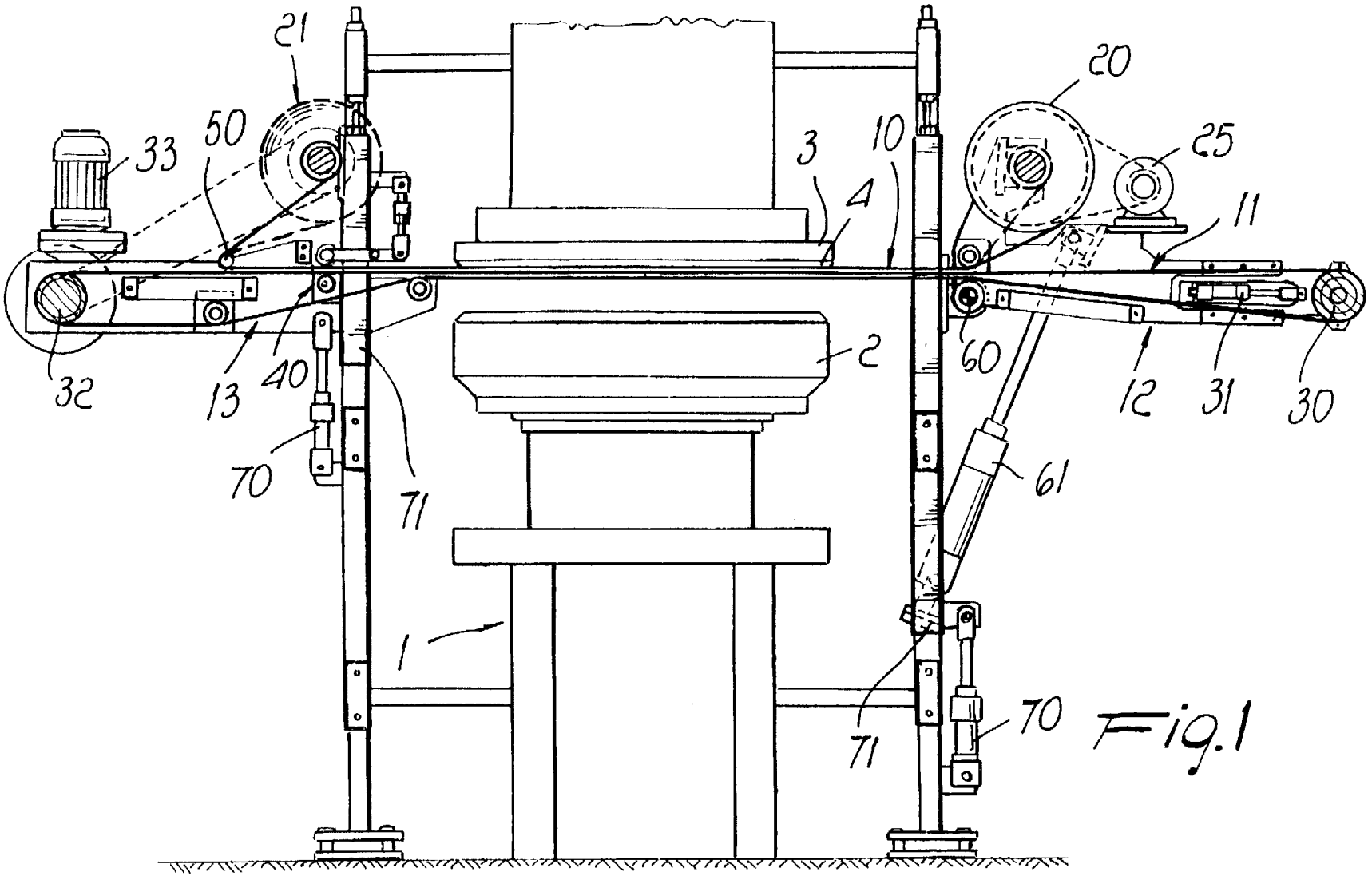
FIG. 1 is a schematic elevation view of the plate press according to the invention.
Figure 4:
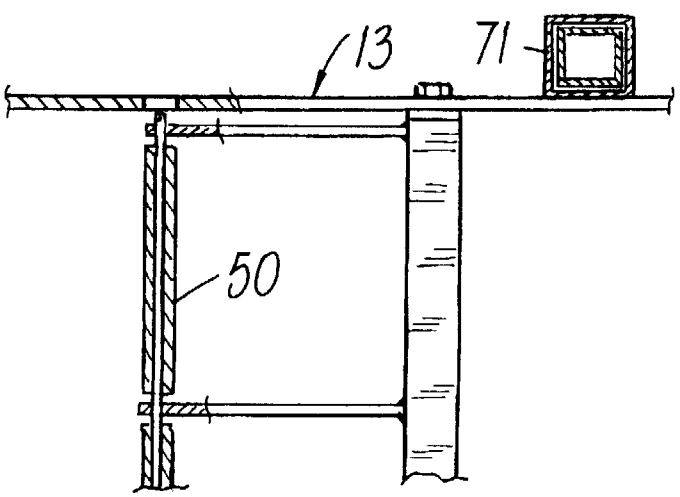
FIG. 4 is a view of the assembly for separating the self-adapting film from the hide.
Figure 3:
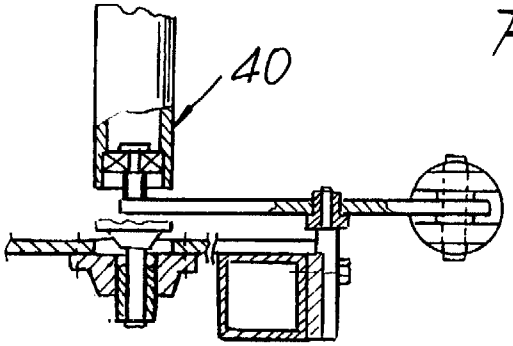
FIG. 3 is a schematic view of the detail of the calendering assembly that keeps the conveyor belt and the self-adapting film together.
Figure 2:
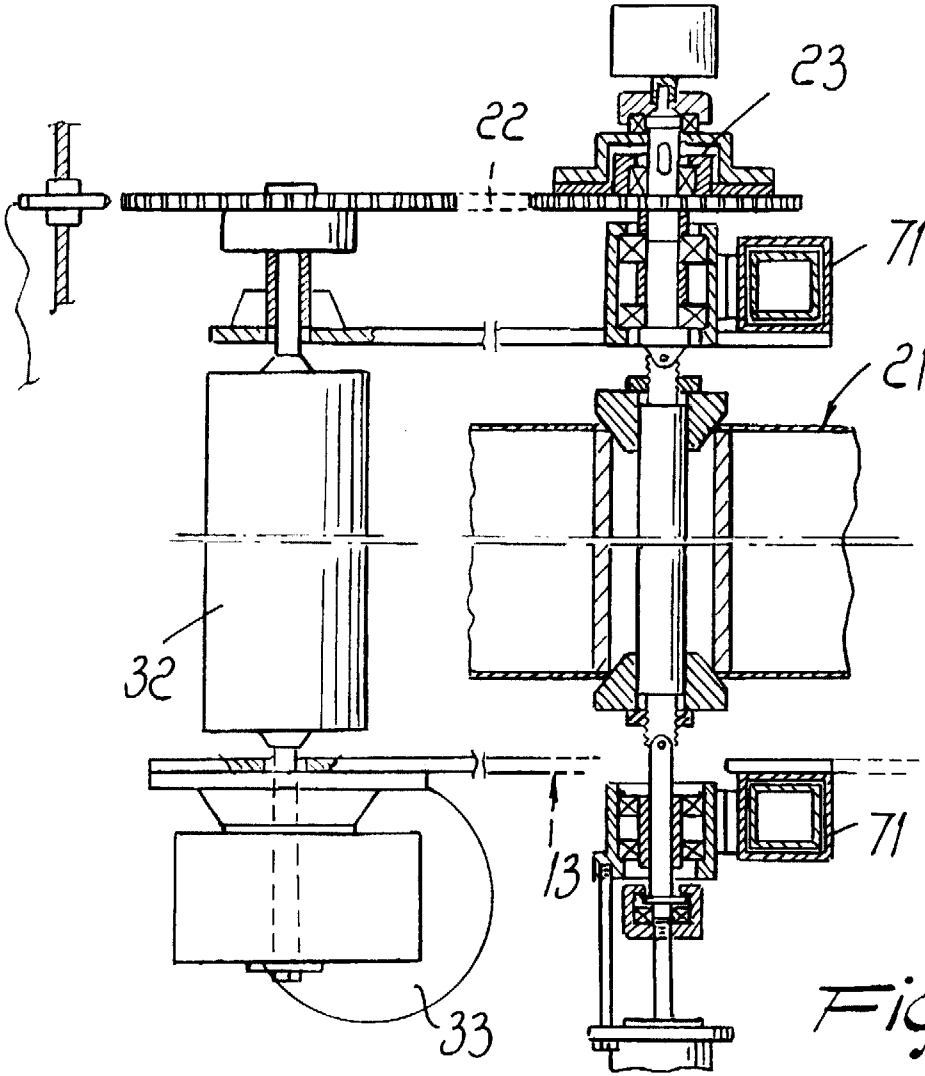
FIG. 2 is a schematic sectional plan view of the belt actuation assembly and of the assembly for taking up the self-adapting film.
Figure 5:
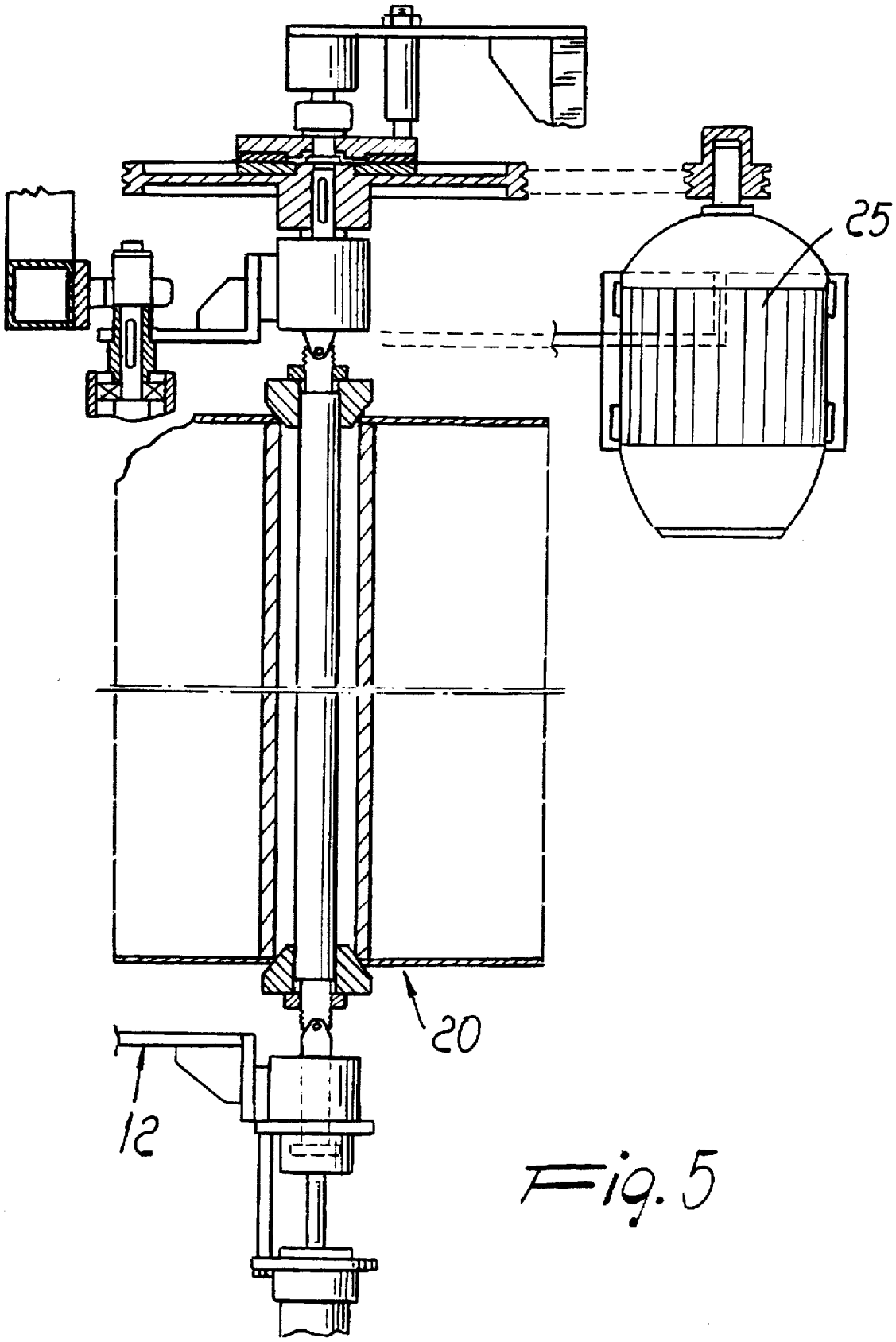
FIG. 5 is a schematic view of the assembly for feeding the self-adapting film.
Figure 7:
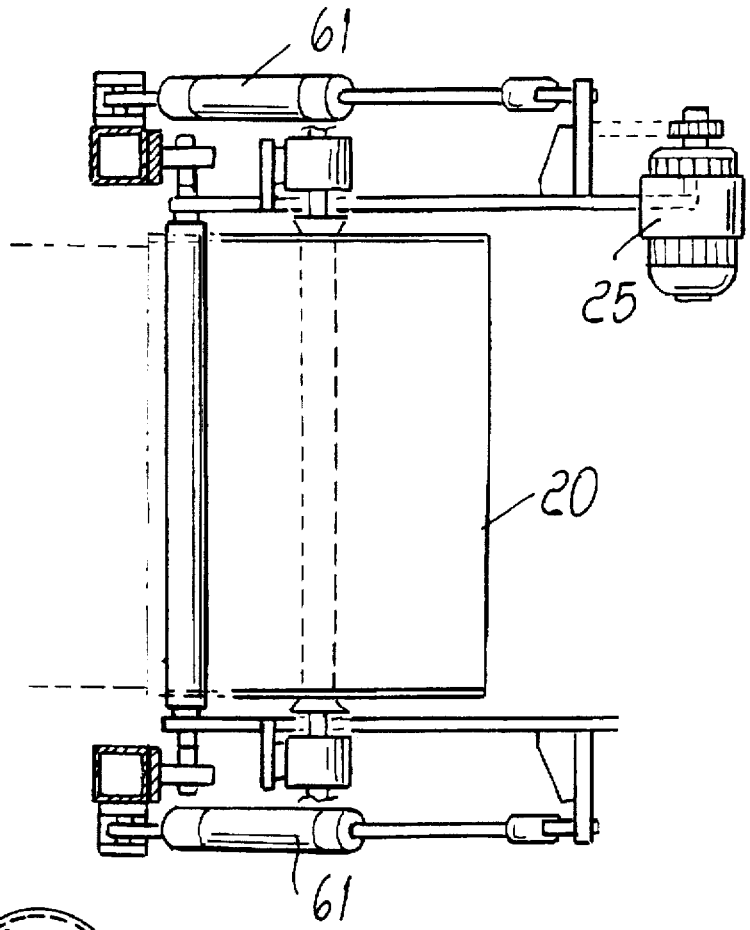
FIG. 7 is a plan view of the self-adapting film feeder assembly.
Figure 6:
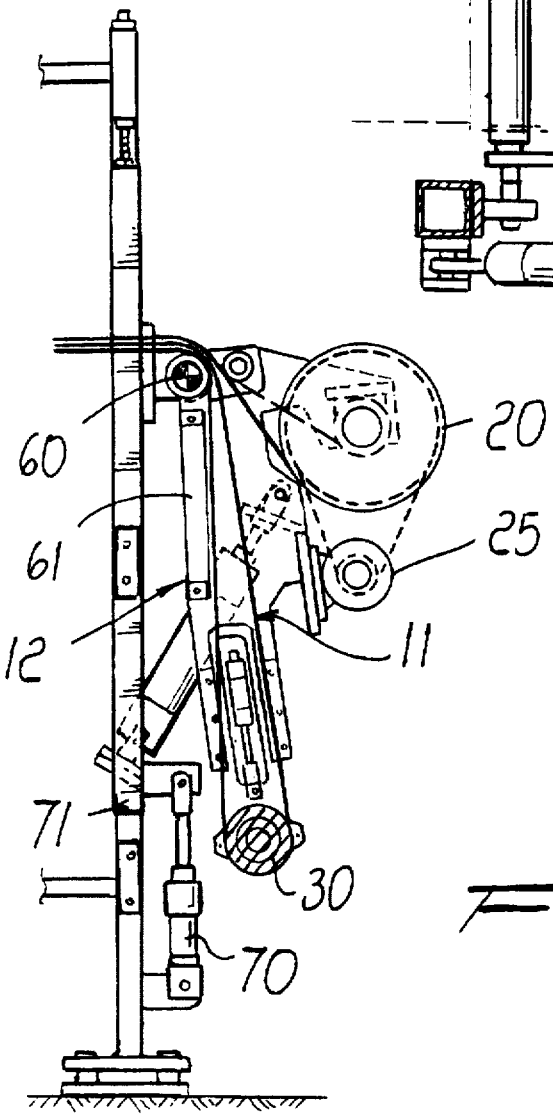
FIG. 6 is a view of the assembly for inserting the hide and for feeding the film, shown in turned-down position to allow replacement of the embossing plates.

With reference to the above figures, the plate press for embossing or glazing, particularly for hides and imitation leather, according to the invention, comprises a supporting frame, generally designated by the reference numeral 1, which supports a lower press plate 2 and an upper press plate 3, which are arranged mutually opposite and are movable with respect to one another, so as to press a hide interposed between the plates.

An embossing plate 4 is applied to one of the plates, for example the upper plate 3, and is provided with a surface finishing that matches the pattern to be formed in the hide that is being dressed.

The particularity of the invention resides in the fact that a self-adapting, temperature-resistant film, designated by the reference numeral 10, is interposed between the press plates, more specifically between the hide to be dressed and the embossing plate 4, and has the purpose of preventing the adhesion between the embossing plate and the hide.

This aspect is extremely important, since it allows to provide the plate press for embossing with an automatic loader that allows to automatically insert the hides beneath the embossing plate.

According to a preferred but not exclusive embodiment, a hide conveyor belt, generally designated by the reference numeral 11, is arranged between the press plates 2 and 3; said belt runs uninterruptedly and is supported by an inlet frame 12 and by an outlet frame 13, which are arranged respectively upstream and downstream of the press with respect to the belt running direction.

The film 10 is fed by a film infeed roller, designated by the reference numeral 20, which is supported by the frame 12 and is taken up by means of a winding roller 21 supported by the frame 13.

More specifically, the frame 12 located upstream of the press with respect to the belt running direction supports a free roller 30 on which the belt unwinds; said roller is connected to a conventional belt tensioner 31.

The belt is actuated by means of a driving roller 32 supported by the frame 13 and connected to an actuation motor 33.

The film 10 advances rigidly with respect to the belt, unwinding from the roller 20, so that the hide is in practice retained between the upper portion of the belt 11 and the film 10, which is arranged on the side towards the embossing plate.

Mutually opposite calendering rollers 40 are arranged at the frame 13 and in practice have the purpose of rigidly coupling the film 10 to the belt 11, so as to avoid relative sliding between the film and the belt.

The hide, which is retained between the film and the belt, is sequentially brought beneath the embossing plate so as to perform the desired dressing of the side of the hide, preventing the hide from adhering to the embossing plate and thus obtaining, on said hide, a dressing that absolutely matches the embossing plate.

For this purpose it is convenient to use a film of plastic material, for example such as polypropylene with a thickness between 15 and 40 microns, preferably 20 microns.

A roller 50 for separating the film from the hide is provided at the exit of the embossing plate and in practice causes a sudden variation in the running direction for the film, which thus separates from the hide.

It is optionally possible to provide a separator roller of the finned type, which facilitates the separation of the film from the hide by acting at the separator roller 50.

The film is fed onto the takeup roller 21, which is motorized, by means of a chain 22, by the motor 33 that actuates the hide advancement belt.

In order to compensate for variations in the diameter of the roller as the film rewinds, a friction clutch 23 is interposed and keeps the film constantly stretched, allowing to achieve relative slippage.

The feeder roller 20 is also connected to a motor 25 that acts as a brake during normal operation and has the purpose of allowing to rewind the film once all the film has passed from the feeder roller 20 to the takeup roller 21.

The rollers 20 and 21 are supported by a system of pneumatically-actuated centers that allow their easy replacement when required.

In order to allow easy access for replacement of the embossing plate, the inlet frame 12 of the belt is mounted so that it can tilt down; for this purpose, the frame 12 is pivoted at 60 to the frame of the press and pistons 61 are provided that are connected between the frame of the press and the frame 12 to tilt said frame 12 downwardly, preventing the film and hide insertion assembly from being a hindrance during replacement of the plate 4.

Both the frame 12 and the frame 13 furthermore allow to lower the belt so as to free the region that is proximate to the upper plate during replacement.

In order to move the belt downwardly, there are double-acting pistons 70 that act on the telescopic posts 71 for supporting the frame 12 and 13.

In practical operation, the hides to be dressed are placed on the belt 11, at the inlet frame, and the belt, during its continuous running, causes said hides to advance by one step, that is to say, by the length of the embossing plate minus the overlap that one wishes to give in order to ensure embossing continuity, that is to say, to perform a complete and uniform dressing of the face of the hide.

The film 10 is initially fully wound on the feeder roller 20.

When the belt advances by one step, the film also advances by the same extent, since the calendering unit 40 jointly couples the film to the belt during translatory motion.

The very low thickness of the film allows it to adapt to any shape etched on the embossing plate without creating dressing drawbacks or defects on the hide.

Once embossing has been performed, the film is separated from the hide by virtue of the sudden change of direction that is imparted to the film by the separator roller 50.

With this arrangement it is therefore possible to dress the hides uninterruptedly, in practice adopting an automatic loader that introduces the hides beneath the embossing plate.

Once the film has been fully unwound from the roller 20, the machine is stopped, and by actuating the motor 25 the film is rewound onto the roller 20, taking it from the takeup roller 21; this actuation can be performed manually or automatically.

It should be added to the above that it is optionally possible to provide for a closed-loop film shape, that is to say, to provide in practice a belt of film that runs uninterruptedly, and it is also optionally possible to replace the conveyor belt with another film that is made to advance uninterruptedly, behaving in practice like a conveyor belt.

From the above description it is thus evident that the invention achieves the intended aim and objects, and in particular the fact is stressed that a press is provided in which adhesion between the hide and the embossing plate is prevented, drastically simplifying all the dressing steps, by adopting a film that is interposed between the hide and the embossing plate, and has a limited thickness, being therefore capable of perfectly adapting to the shape of the plate, as well as of withstanding the temperature. This important aspect is achieved because it is no longer necessary to manually separate the hide from the embossing plate and because it is possible to use an automatic conveyor to introduce the film beneath the press plates.

The invention thus conceived is susceptible of numerous modifications and variations, all of which are within the scope of the inventive concept.

All the details may furthermore be replaced with other technically equivalent elements.

In practice, the materials employed, as well as the contingent shapes and dimensions, may be any according to the requirements.

What is claimed is:

1. Plate press for embossing and glazing hides or imitation leather, comprising: a frame that supports a lower plate and an upper plate; an embossing plate for dressing a side of a hide, said embossing plate being associable with one of said plates; a film that is self-adapting, temperature-resistant, and is interposable between said embossing plate and said hide to prevent adhesion of said hide to said embossing plate; and an automatic loader for automatically feeding said hides to be dressed at said embossing plate, said film and said loader being jointly advanced without relative sliding and while retaining said hides therebetween.

2. Embossing and glazing plate press according to claim 1, wherein said automatic loader is a conveyor belt for feeding hides, said belt being interposed between said lower and upper plates.

3. Press according to claim 2, wherein said hide conveyor belt runs uninterruptedly and is supported by an inlet frame and an outlet frame, said frames being respectively located upstream and downstream of the press with respect to a running direction of said belt.

4. Press according to claim 3, further comprising a film feeder roller supported by said inlet frame, and a film takeup roller supported by said outlet frame.

5. Press according to claim 4, comprising, on said outlet frame, a driving roller for actuation of said belt, said driving roller being operatively connected to the film takeup roller, friction means being furthermore provided at said driving roller for keeping the film constantly stretched.

6. Press according to claim 3, comprising mutually opposite calendering rollers for jointly coupling said belt and said film during translatory motion thereof.

7. Press according to claim 3, comprising, on said outlet frame, a roller for separating the film from the hide, said roller producing a sudden change in an unwinding direction of said film.

8. Press according to claim 4, comprising a motor that is operatively associated with said film feeder roller, said motor acting as a brake during unwinding of the film and as a takeup motor to rewind the film onto said feeder roller at an end of the unwinding of the film.

9. Press according to claim 3, wherein said inlet frame is mounted on said frame for being tiltable downwardly in order to allow access for replacing the embossing plate, pistons being furthermore provided for tilting down said frame.

10. Press according to claim 3, comprising translatory motion means for translatory motion of said belt in a vertical plane to space the belt from the embossing plate during replacement, said translatory motion means being constituted by double-acting pistons, said double-acting pistons acting on telescopic supporting posts of said frame.

11. Press according to claim 1, wherein said film is made of plastic material such as polypropylene.

12. Press according to claim 1, wherein said film has a thickness of 15 to 40 microns, and in a preferred embodiment 20 microns.

13. Press according to claim 1, wherein said film runs uninterruptedly.

14. Press according to claim 2, wherein said conveyor belt is constituted by a further film which acts as a conveyor for advancement of said hides.

15. Plate press for embossing and glazing hides or imitation leather, comprising: a supporting frame that supports a lower plate and an upper plate; an embossing plate for dressing a side of a hide, said embossing plate being associable with one of said plates; a film that is self-adapting, temperature-resistant, and is interposable between said embossing plate and said hide to prevent adhesion of said hide to said embossing plate; and an automatic loader to automatically feed said hides for dressing at said embossing plate, said loader consisting in a conveyor belt, said film and said conveyor belt being jointly coupled for retaining said hides and advancing without relative sliding therebetween.

16. Embossing and glazing plate press according to claim 15, wherein the conveyor belt for feeding hides is constituted by a further said film, said further film being interposed between said lower and upper plates.

17. Press according to claim 15, wherein said hide conveyor belt runs uninterruptedly and is supported by an inlet frame and an outlet frame, said inlet and outlet frames being respectively located upstream and downstream of the press with respect to a running direction of said belt, and wherein said inlet frame is mounted on said supporting frame for being tiltable downwardly in order to allow access for replacing the embossing plate, pistons being furthermore provided for tilting down said frame.

18. Press according to claim 15, comprising mutually opposite calendering rollers for jointly coupling said belt and said film during translatory motion thereof.

19. Plate press for embossing and glazing hides or imitation leather, comprising: a supporting frame that supports a lower plate and an upper plate; an embossing plate for dressing a side of a hide, said embossing plate being associable with one of said plates; a film that is self-adapting, temperature-resistant, and is interposable between said embossing plate and said hide to prevent adhesion of said hide to said embossing plate; a conveyor belt to automatically feed said hides for dressing at said embossing plate; and coupling means for jointly coupling said film and said conveyor belt to advance without relative sliding and to retain said hides therebetween.

20. Press according to claim 19, wherein said coupling means comprise mutually opposite calendering rollers for jointly coupling said belt and said film during translatory motion thereof.

* * * * *